US008434699B2

(12) United States Patent
Faupel

(10) Patent No.: US 8,434,699 B2
(45) **Date of Patent: *May 7, 2013**

(54) HOSE-END SPRAYER BOTTLES WITH SAFETY FEATURES

(75) Inventor: Wayne C. Faupel, Bedford, PA (US)

(73) Assignee: Green Garden Products Company, Bedford, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/108,808

(22) Filed: May 16, 2011

(65) Prior Publication Data

US 2011/0309163 A1 Dec. 22, 2011

Related U.S. Application Data

(63) Continuation of application No. 12/372,695, filed on Feb. 17, 2009, now Pat. No. 7,942,346.

(60) Provisional application No. 61/028,869, filed on Feb. 14, 2008.

(51) Int. Cl.
*B05B 7/30* (2006.01)

(52) U.S. Cl.
USPC ..... 239/318; 239/310; 239/375; 239/414; 239/525; 239/581.1; 222/153.09

(58) Field of Classification Search ..... 239/302, 239/310, 316, 317, 318, 375, 414, 525, 569, 239/581.1; 222/153.01, 153.09
See application file for complete search history.

(56) References Cited

U.S. PATENT DOCUMENTS

| | | | | |
|---|---|---|---|---|
| 4,345,691 | A * | 8/1982 | Burke | 222/153.09 |
| 6,471,141 | B2 * | 10/2002 | Smith et al. | 239/414 |
| 6,749,133 | B1 * | 6/2004 | Ketcham et al. | 239/318 |
| 6,772,966 | B2 * | 8/2004 | Foster et al. | 239/581.1 |
| 7,118,049 | B2 * | 10/2006 | Dodd | 239/310 |
| 7,661,604 | B1 * | 2/2010 | MacLean-Blevins | 239/525 |
| 7,942,346 | B2 * | 5/2011 | Faupel | 239/318 |
| 2005/0184172 | A1 * | 8/2005 | Shanklin et al. | 239/318 |

* cited by examiner

*Primary Examiner* — Steven J Ganey
(74) *Attorney, Agent, or Firm* — Reed Smith LLP

(57) ABSTRACT

Safety features in and for hose-end sprayer bottles. In a first safety arrangement, there is ensured a more hindered transition of a spool (e.g., product/carrier spool) or adjuster from a first setting to a second setting than from the second setting to the first setting, wherein in the first setting no carrier stream is admitted through the sprayer and in the second setting solely a carrier stream is admitted through the sprayer. In a second safety arrangement, there is arrested displacement of a container interface (e.g., bottle swivel) from a second (essentially advanced) position towards a first (essentially initial) position upon the container interface displacing from the first position to the second position.

15 Claims, 5 Drawing Sheets

HOSE-END SPRAYER BOTTLES WITH SAFETY FEATURES

CROSS-REFERENCE TO RELATED U.S. APPLICATION

This application is a continuation of and claims the benefit under 35 U.S.C. §120 of the earlier filing date of U.S. patent application Ser. No. 12/372,695 filed on Feb. 17, 2009 which claims the benefit under 35 U.S.C. §119(e) of the earlier filing date of U.S. Provisional Application Ser. No. 61/028,869, filed on Feb. 14, 2008, which are hereby incorporated by reference.

FIELD OF THE INVENTION

The present invention generally relates to hose-end sprayers and their constituent components, as well as to safety features therefor.

BACKGROUND OF THE INVENTION

Hose-end sprayers are generally well-known and are described, for example, in U.S. Pat. No. 6,425,534 (issued Jul. 30, 2002), U.S. Pat. No. 5,372,310 (Dec. 3, 1994) and U.S. Pat. No. 5,320,288 (Jun. 14, 1994). These patents provide general background information with regard to hose-end sprayers that may be of use in better understanding the makeup and functioning of various embodiments of the present invention. For instance, these patents provide illustrative and non-restrictive examples of how a carrier stream and chemical product can be selectably mixed and admitted through a sprayer, and how alternatively solely a carrier stream can be admitted.

Generally, a strong and compelling need has been recognized in connection with providing hose-end sprayers and similar arrangements with effective safety features to prevent, at the very least, inadvertent spilling or leaking of chemical product in general and/or access to chemical product by children in particular.

SUMMARY OF THE INVENTION

There are broadly contemplated herein, in accordance with at least one presently preferred embodiment of the present invention, safety features in and for hose-end sprayer bottles in which different safety arrangements are realizable and can work either alone or in combination.

In a first safety arrangement, there is ensured a more hindered transition of a spool (e.g., product/carrier spool) or adjuster from a first setting to a second setting than from the second setting to the first setting, wherein in the first setting no carrier stream is admitted through the sprayer and in the second setting solely a carrier stream is admitted through the sprayer.

In a second safety arrangement, there is arrested displacement of a container interface (e.g., bottle swivel) from a second (essentially advanced) position towards a first (essentially initial) position upon the container interface displacing from the first position to the second position.

In summary, there is broadly contemplated herein, in accordance with at least one presently preferred embodiment of the present invention, a hose-end sprayer apparatus for attachment to a hose, the apparatus comprising: a sprayer which selectably admits throughput of a carrier stream from a hose; a container interface for interfacing with a container which contains product for mixing with a carrier stream; an adjuster which establishes a delivery condition of a carrier stream and product; the adjuster being actuable between: a first setting, wherein no carrier stream is admitted through the sprayer; a second setting, wherein solely a carrier stream is admitted through the sprayer; a third setting, wherein product is admitted into a carrier stream admitted through the sprayer; and a safety arrangement which acts to ensure a more hindered transition of the adjuster from the first setting towards the third setting than from the third setting towards the first setting.

Further, there is broadly contemplated herein, in accordance with at least one presently preferred embodiment of the present invention, a hose-end sprayer apparatus for attachment to a hose, the apparatus comprising: a sprayer which selectably admits throughput of a carrier stream from a hose; a container adapted to contain product for mixing with a carrier stream; a container interface for interfacing the sprayer with the container; the container interface being displaceable with respect to the container; the container interface being displaceable between a first position, wherein the container interface is removable from the container, and a second position; and a safety arrangement which acts to arrest displacement of the container interface from the second position towards the first position upon the container interface displacing from the first position to the second position; the safety arrangement comprising: a first contact medium associated with the container interface; and a second contact medium associated with the container; the second contact medium acting to contact the first contact medium as the container interface displaces from the second position towards the first position and thereby arrest displacement of the container interface from the second position towards the first position.

Additionally, there is broadly contemplated herein, in accordance with at least one presently preferred embodiment of the present invention, a hose-end sprayer apparatus for attachment to a hose, the apparatus comprising: a sprayer which selectably admits throughput of a carrier stream from a hose; a container adapted to contain product for mixing with a carrier stream; a container interface for interfacing the sprayer with the container; the container interface being displaceable with respect to the container; the container interface being displaceable between a first position, wherein the container interface is removable from the container, and a second position; an adjuster which establishes a delivery condition of a carrier stream and product; the adjuster being actuable between: a first setting, wherein no carrier stream is admitted through the sprayer; a second setting, wherein solely a carrier stream is admitted through the sprayer; a third setting, wherein product is admitted into a carrier stream admitted through the sprayer; a first safety arrangement which acts to ensure a more hindered transition of the adjuster from the first setting towards the third setting than from the third setting towards the first setting; and a second safety arrangement which acts to arrest displacement of the container interface from the second position towards the first position upon the container interface displacing from the first position to the second position; the second safety arrangement comprising: a first contact medium associated with the container interface; and a second contact medium associated with the container; the second contact medium acting to contact the first contact medium as the container interface displaces from the second position towards the first position and thereby arrest displacement of the container interface from the second position towards the first position.

The novel features which are considered characteristic of the present invention are set forth herebelow. The invention itself, however, both as to its construction and its method of operation, together with additional objects and advantages thereof, will be best understood from the following description of the specific embodiments when read and understood in connection with the accompanying drawings.

BRIEF DESCRIPTION OF THE DRAWINGS

The present invention and its presently preferred embodiments will be better understood by way of reference to the detailed disclosure herebelow and to the accompanying drawings, wherein.

DETAILED DESCRIPTION OF THE PREFERRED EMBODIMENTS

Figure 1:
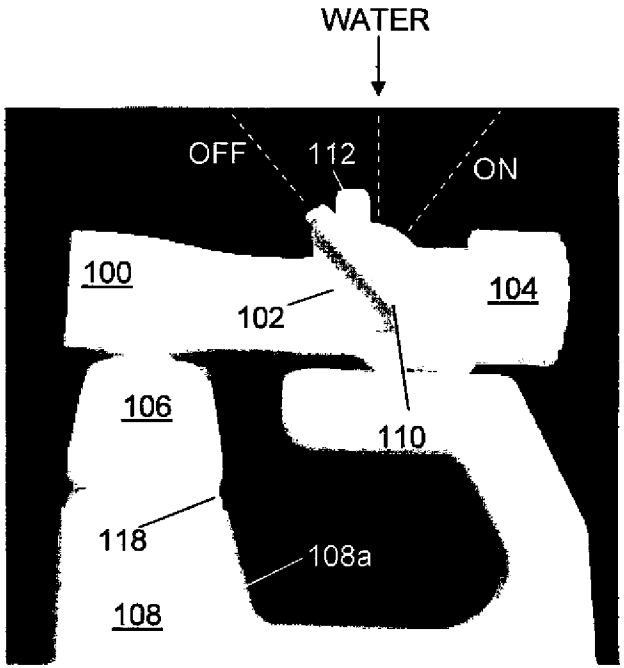
FIG. 1 provides an elevational view of a portion of a hose-end sprayer bottle arrangement.
Figure 2:
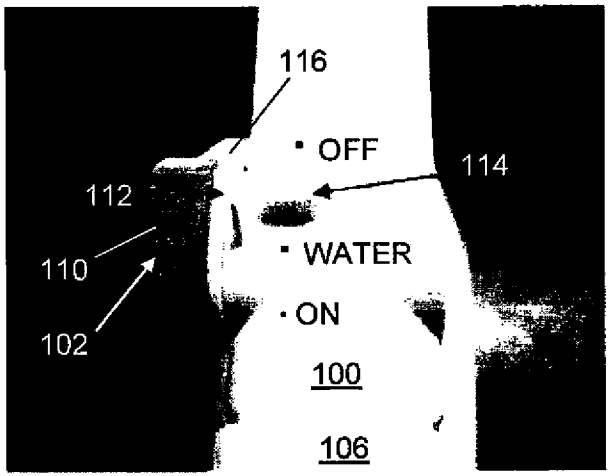
FIG. 2 provides a perspective view of a sprayer from the arrangement of FIG. 1.
Figure 3:
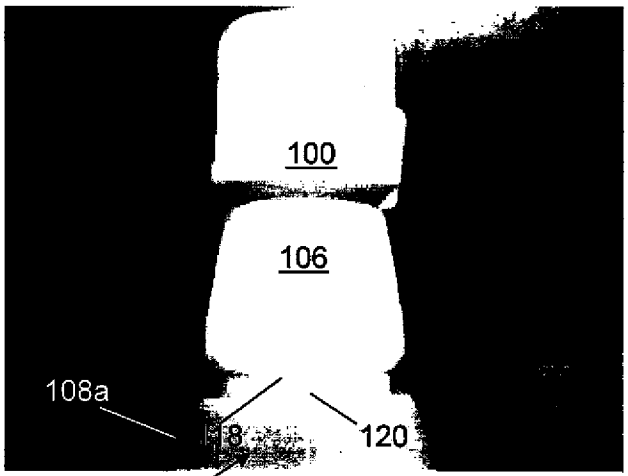
FIG. 3 is essentially the same view as FIG. 1 but rotated about 90 degrees along a vertical axis.

FIGS. 1-5*b* provide various views of a hose-end sprayer bottles with safety features in accordance with embodiments of the present invention. Reference may be made to all figures in connection with the discussion herebelow. Particularly reference may first be made to FIGS. 1-3, however, where FIG. 1 provides an elevational view of a portion of a hose-end sprayer bottle arrangement, FIG. 2 provides a perspective view of a sprayer from the arrangement of FIG. 1, and FIG. 3 is essentially the same view as FIG. 1 but rotated about 90 degrees along a vertical axis.

As known, a sprayer 100 may preferably include a rotatable spool 102 which can attain different predetermined settings. The sprayer 100 preferably has a hose connector 104 at one end configured for interfacing with a hose, while a bottle swivel 106 preferably provides a threaded connection with the neck 108*a* of a bottle 108 containing a product (such as chemical product, including powdered or liquid or other product).

As shown, there may preferably be three settings on the sprayer, "OFF", "WATER" and "ON", as well-known to those of ordinary skill in the art. "OFF" corresponds to the lack of any flow of any substance through the sprayer 100, "WATER" corresponds to the flow of solely a "carrier stream" of water (or other liquid from a hose) through the sprayer 100 and "ON" generally corresponds to the combined flow of both the carrier stream and product (from the bottle) through the sprayer 100. As shown in FIG. 2, these three settings are preferably labeled clearly on an external surface of the sprayer 100.

Generally, the three aforementioned settings are attainable via rotating the spool 102 via a small control knob 110 that can be gripped, e.g., by a finger and thumb (e.g., a rectilinear protrusion of material from a circular outer surface of the spool 102, which protrusion has a major dimension running in a radial direction across substantially a full diameter of this circular outer surface). FIG. 1 shows how a rotational position of the spool 102 can correspond to these three settings (which, for their part, are indicated by dotted lines running in radial directions with respect to the spool 102).

Normally, the three aforementioned settings are easily attainable merely by virtue of rotating the spool 102, without significant impediment being provided to such rotation (other than, e.g., frictional contact between the spool 102 and a cylindrical recess inside the sprayer 100 which houses the spool 102). However, in accordance with a presently preferred embodiment of the present invention, a safety feature is preferably provided which does present a structural impediment to rotation of the spool 102 and thus greatly reduces the likelihood of inadvertent spool rotation (e.g., by a child).

As shown, the sprayer body preferably includes a longitudinal tab 112, whose major dimension lies essentially in parallel with respect to a longitudinal axis of the sprayer 100 and is located close to that side of the spool 102 containing the spool control knob 110. Preferably disposed adjacent this longitudinal tab, on the sprayer body, is a transverse tab 114, whose major dimension lies in perpendicular to that of the longitudinal tab 112 and extends transversely in a direction perpendicular to the longitudinal axis of the sprayer 100. With relation to the three spool positions, the longitudinal and transverse tabs (112 and 114, respectively) are preferably disposed between the "WATER" and "OFF" positions.

Preferably mounted at an end of the spool control knob is a tab 116 which extends a short distance transversely away from the control knob 110 (i.e., in a direction into the drawing in FIG. 1 and to the right in FIG. 2) such that when this spool tab 116 contacts the sprayer longitudinal tab, further rotational movement of the spool 102 will be impeded. Preferably, this blocking of rotational movement of the spool 102 will apply regardless of the direction from which the spool tab 116 contacts the longitudinal tab 112. Accordingly, the longitudinal tab 112 will preferably be sufficiently flexible as to permit its being bent towards the transverse tab 114 so as to provide just enough clearance (even with some small degree of contact) for the spool tab 116 to move past the longitudinal tab 112 (and, thus, for the spool 102 to continue rotating past the longitudinal tab 112 in either rotational direction away from the longitudinal tab 112). Preferably, a primary role of the transverse tab 114 will be to limit this bending movement of the longitudinal tab 112 and thereby prevent any likelihood of over-bending the longitudinal tab 112 and risking its breakage.

It will be readily appreciated that by virtue of the safety feature just described, once the spool 102 is in the "OFF" position, inadvertent rotation of the spool 102 out of the "OFF" position will be next to impossible and: (a) not only will, e.g., a child be substantially prevented from allowing a combined water and product stream to issue from the sprayer 100; but (b) the final effect will be one of extra sealing, such that any inadvertent movement of the bottle (e.g., falling off of a table) will almost certainly not be sufficient to jar the spool 102 out of the "off" position and thus cause, e.g., an inadvertent leaking of product from the bottle 108. In other words, as can be appreciated with reference to the aforementioned U.S. Patents herein incorporated by reference, a channel for product will not be opened unless the spool tab 116 (also termed the "control knob tab" herein) passes the longitudinal tab 112 and is in the "ON" position. It will further be appreciated that as the control knob 110 moves from "ON" to "OFF", passing through the "WATER" position, any residual product in the sprayer 100 (in the case of a partially used bottle) will be cleaned out of (i.e., removed from) the sprayer 100 by the carrier stream.

Preferably, in the "WATER" position, the control knob 110 tab will nearly, but not quite, be in contact with the longitudinal tab 112, thus permitting a highly eased transition between the "ON" and "WATER" positions.

Figure 4:
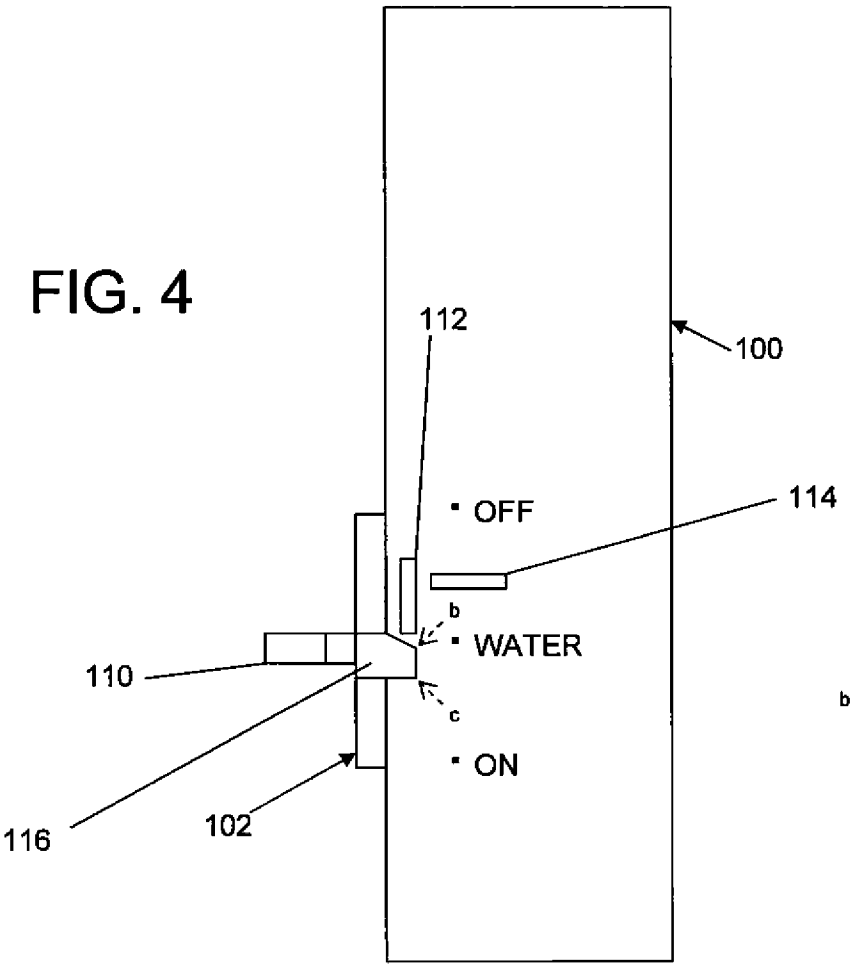
FIG. 4 provides a highly schematicized top view of a sprayer.

As shown in detail now in FIG. 4 (itself a highly schematicized top view of the sprayer 100), the control knob tab 116 may be provided with a bevel, or angular cut, (b) such that when the spool 102 is rotating in a direction from "ON" towards "OFF", the control knob tab 116 will encounter less of an impediment at the longitudinal tab 112 and thus will be able to move past the longitudinal tab 112 without requiring that the longitudinal tab 112 be additionally bent. In other words, the bevel or angular cut (b) will preferably engage the longitudinal tab 112 in such a way that the longitudinal tab 112 will be caused to be bent towards the transverse tab 114 merely by virtue of the spool 102 being rotated in the direction from "ON" towards "OFF".

Of course, no such bevel or angular cut will preferably be provided on the control knob tab 116 in a way to provide such an ease of movement when the spool 102 is rotated in a direction from "OFF" towards "ON"; in that instance, the control knob tab 116 will preferably engage the longitudinal tab 112 directly and in such a way that further rotational movement of the spool 102 is next to impossible until an additional effort is made to simultaneously bend the longitudinal tab 112 towards the transverse tab 114 (i.e., by an external force other than that provided merely by rotation of the spool 102). This lack of a bevel or angular cut is indicated in FIG. 4 by way of the right-angle corner indicated at (c).

Referring back to FIG. 3, when the hose end sprayer 100 is attached to the bottle 108, two legs or tabs that extend below the bottle swivel 106 will preferably serve to prevent the sprayer 100 from being removed from the bottle 108; one such leg (or tab) 118 is shown in FIG. 3 but it should be understood that a second leg will preferably be disposed diametrically opposite from the one shown. In a manner to be appreciated herebelow, these tabs 118 will preferably clear and then be blocked by stops on the neck 108*a* of bottle 108 to prevent return rotation of the bottle swivel 106; one such stop is indicated at 120.

More particularly, the bottle swivel 106 is preferably configured, as known, for threaded engagement with a neck 108*a* of the bottle 108. Accordingly, as known, the bottle swivel 106 will preferably tighten onto the neck 108*a* of bottle 108 with clockwise displacement of the bottle swivel 106 with respect to the bottle neck 108*a*. (As is also well known, the sprayer 100 is preferably pivotably connected with the bottle swivel 106 so that once the bottle swivel 106 is tightened with respect to the bottle [108) neck 108*a*, the sprayer 100 will be able to undergo pivotable displacement with respect to the bottle 108.)

However, in accordance with a presently preferred embodiment of the present invention, the bottle swivel 106 preferably locks with respect to the bottle neck 108*a* after the aforementioned clockwise tightening with respect to the bottle neck 108*a* and by virtue of the aforementioned tabs and stops. Particularly, once the bottle swivel 106 is close to being fully tightened with respect to the bottle neck 108*a*, the two bottle swivel tabs 118 will preferably just clear the bottle neck stops 120 whereupon the tabs 118 will be in a position where they can no longer be displaced rotationally, in a (return) counterclockwise direction of the bottle swivel 106, past the stops 120. In other words, a substantially vertical edge of each tab 120 will preferably come into contact with a substantially vertical edge of each stop 118 when any attempt is made to unscrew the bottle swivel 106 from the bottle neck 108*a* in a counterclockwise direction. (It should be noted that the "clockwise" and "counterclockwise" directions presented here are for illustrative purposes only and are understood to relate to rotational directions as viewed from a top view of the bottle 108.)

Figure 5B:
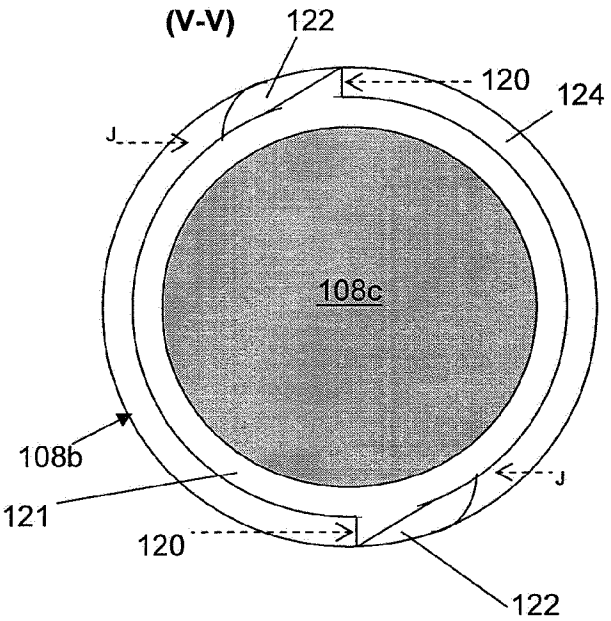
FIG. 5*b* provides a top cross-sectional view of a flange and bottle neck portion taken along line V-V.
Figure 5A:
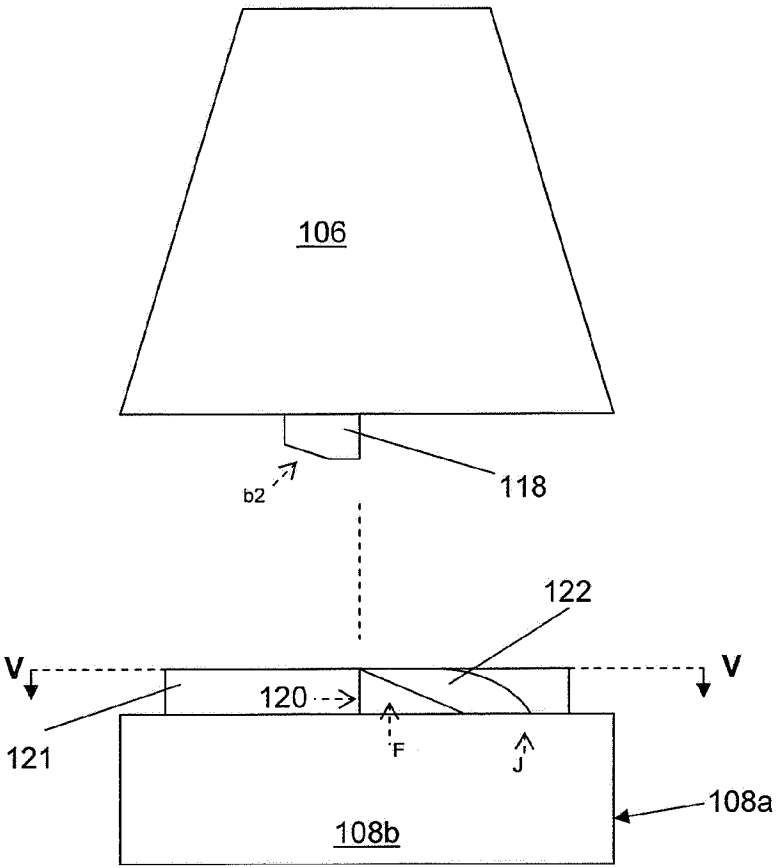
FIG. 5*a* provides a highly schematicized exploded elevational view of a bottle swivel and a portion of a bottle neck.

To help illustrate this phenomenon further, FIG. 5*a* provides a highly schematicized exploded elevational view of the bottle swivel 116 and a portion 108*b* of the bottle neck 108*a* while FIG. 5*b* provides a top cross-sectional view of a flange and bottle neck portion taken along line V-V. Both FIGS. 5*a* and 5*b* will now be referred to jointly.

Preferably, a flange 121 of smaller general diameter than the illustrated bottle neck portion 108*b* is disposed atop the bottle neck portion 108*b* and forms a bottom portion of an externally threaded bottle neck portion (not shown) extending thereabove which engages with internal threads of the bottle swivel 106. (It should thus be understood that in FIG. 5*a* there are portions of the bottle neck 108*a* above the flange 121 that are not shown, to provide an ease of illustration.) Also shown is a central opening 108*c* of bottle neck portion 108*b* (and by extension, of bottle neck 108*a*).

As shown, the bottle neck 108*a* (and particularly portion 108*b* thereof) is preferably provided with a pair of ramps 122 fused with or otherwise disposed immediately adjacent to the flange 121. When the bottle swivel is close to being fully tightened on the bottle neck, the bottle swivel tabs (only one of which is shown in FIG. 5*a* to facilitate illustration) will engage with the ramps 122, "ride" the ramps 122 and thence "click" into place adjacent the stops 120 once each tab 118 clears each stop 120. An unscrewing of the bottle swivel 106 from the bottle neck 108*a* will now be next to impossible since, with an unscrewing (here, counterclockwise) movement of the bottle swivel, the essentially vertical edge of each tab 118 will directly engage the essentially vertical edge of each stop 120.

Each ramp 122 is preferably configured to push each tab 118 radially outwardly (with respect to a central axis of the bottle swivel 106 and bottle neck 108*a*); accordingly, each ramp 122 preferably has an outer surface that is essentially flush with the flange 121 at a junction point (J) but then, essentially, is increasingly disposed further away in a radial direction from the flange 121 and further away in a vertical direction from the flat annular surface 124 adjacent the flange 121 (see FIG. 5*b*) as a function of clockwise angular distance from the junction point (J), thence terminating at a stop 120. Just prior to terminating at a stop 120, each ramp 122 may preferably include a small arcuate front surface (F) that preferably runs in parallel to the circular periphery of the flange 121 and the bottle neck 108*a*.

Accordingly, each ramp 122 preferably provides a gradual transition, in the path of movement of a tab 118, from junction point (J) to front surface (F), whereby the tab 118 then immediately transitions radially (e.g., as a "click") back to a position of rest adjacent the flange 121. Each ramp 122 may preferably be configured in essentially any suitable manner that readily effects the gradual transition just described; preferably, the outer surface of each ramp 122 may be appropriately curved for the purpose. Further, as an additional aid in the gradual transition just mentioned, each tab 118 may preferably include a bevel (b2) that provides an ease of movement of each tab along and adjacent each ramp (and thereby an eased gradual transition from junction point [J] to the abrupt "click" just beyond stop [s]).

Without further analysis, the foregoing will so fully reveal the gist of the present invention and its embodiments that others can, by applying current knowledge, readily adapt it for various applications without omitting features that, from the standpoint of prior art, fairly constitute characteristics of the generic or specific aspects of the present invention and its embodiments.

If not otherwise stated herein, it may be assumed that all components and/or processes described heretofore may, if appropriate, be considered to be interchangeable with similar components and/or processes disclosed elsewhere in the specification, unless an express indication is made to the contrary.

If not otherwise stated herein, any and all patents, patent publications, articles and other printed publications discussed or mentioned herein are hereby incorporated by reference as if set forth in their entirety herein.

It should be appreciated that the apparatus and method of the present invention may be configured and conducted as appropriate for any context at hand. The embodiments described above are to be considered in all respects only as illustrative and not restrictive. All changes which come within the meaning and range of equivalency of the claims are to be embraced within their scope.

What is claimed is:

1. A hose-end sprayer apparatus for attachment to a hose, said apparatus comprising:

a sprayer which selectably admits throughput of a carrier stream from a hose;

a container interface for interfacing with a container which contains product for mixing with a carrier stream;

an adjuster which establishes a delivery condition of a carrier stream and product;

said adjuster being actuable between:

a first setting, wherein no carrier stream is admitted through said sprayer;

a second setting, wherein solely a carrier stream is admitted through said sprayer;

a third setting, wherein product is admitted into a carrier stream admitted through said sprayer; and a safety arrangement which acts to ensure a more hindered transition of said adjuster from said first setting towards said third setting than from said third setting towards said first setting, said second setting is intermediate to said first and third settings;

said safety arrangement comprises:

a tab disposed on said sprayer, said tab being displaceable in a direction different than a direction corresponding to a linear direction of travel of said first and second engagement portions;

a first engagement portion, disposed on said adjuster, which is engageable with said tab as said adjuster transitions from said first setting to said second setting; and a second engagement portion, disposed on said adjuster, which is engageable with said tab as said adjuster transitions from said second setting to said first setting;

said first engagement portion and said second engagement portion being comparatively shaped to ensure a more hindered transition of said adjuster from said first setting to said second setting than from said second setting to said first setting;

wherein said first engagement portion comprises an edge configured to displace said tab as said adjuster transitions from said first setting to said second setting;

wherein said second engagement portion comprises a bevel configured to displace said tab as said adjuster transitions from said second setting to said first setting.

2. The apparatus according to claim 1, wherein said tab is displaceable in a direction essentially perpendicular to a direction corresponding to a linear direction of travel of said first and second engagement portions.

3. The apparatus according to claim 2, wherein the direction corresponding to a linear direction of travel of said first and second engagement portions is generally parallel to a direction of travel of a carrier stream through said sprayer.

4. The apparatus according to claim 2, wherein said edge is oriented essentially in perpendicular with respect to the direction corresponding to a linear direction of travel of said first and second engagement portions.

5. The apparatus according to claim 1, wherein said tab comprises an integral extension of said sprayer.

6. The apparatus according to claim 1, wherein said safety arrangement further comprises a support tab, said support tab acting to arrest movement of said tab.

7. The apparatus according to claim 6, wherein said tab has a major dimension oriented essentially in parallel to the direction corresponding to a linear direction of travel of said first and second engagement portions.

8. The apparatus according to claim 7, wherein said support tab has a major dimension oriented essentially in perpendicular with respect to said major dimension of said tab.

9. A hose-end sprayer apparatus for attachment to a hose, said apparatus comprising:

a sprayer which selectably admits throughput of a carrier stream from a hose;

a container adapted to contain product for mixing with a carrier stream;

a container interface for interfacing said sprayer with said container, said container comprising a container neck portion having an annular flange and a flat annular surface extending in a direction transverse to the annular flange;

said container interface being displaceable with respect to said container;

said container interface being rotatable about a rotational axis extending in a longitudinal direction between a first position, wherein said container interface is removable from said container, and a second position; and a safety arrangement which acts to arrest displacement of said container interface from said second position towards said first position upon said container interface displacing from said first position to said second position;

said safety arrangement comprising:

a tab extending below said container interface, said tab having a first surface extending in the longitudinal direction; and a ramp and an integral stop associated with said container, said stop comprising a second surface extending in the longitudinal direction, said ramp having a slope extending from the flat annular surface of the container neck;

said second surface acting to contact said first surface as said container interface displaces from said second position towards said first position and thereby arrest displacement of said container interface from said second position towards said first position;

said ramp acting to guide said tab such that said tab travels along said ramp and clears said stop as said container interface displaces from said first position towards said second position.

10. The apparatus according to claim 9, wherein:

said tab further comprises a beveled surface on a surface transverse to the first surface, wherein said beveled surface travels along the ramp as said container interface displaces from said first position towards said second position.

11. The apparatus according to claim 9, wherein said ramp acts to displace said tab radially away from the rotational axis of said container interface as said container interface displaces from said first position towards said second position.

12. The apparatus according to 9, wherein said container interface and said container are threadedly engageable with respect to one another.

13. The apparatus according to claim 9, wherein said safety arrangement further comprises:

a second tab associated with said container interface, said second tab extending below said container interface; and a second ramp and second integral stop associated with said container;

said second ramp and second integral stop to contact said second tab as said container interface displaces from said second position towards said first position and thereby arrest displacement of said container interface from said second position towards said first position.

14. The apparatus according to claim 13, wherein:

said second tab is each respectively offset from said the first mentioned tab by about 180 degrees with respect to the rotational axis of said container interface.

15. A hose-end sprayer apparatus for attachment to a hose, said apparatus comprising:

a sprayer which selectably admits throughput of a carrier stream from a hose;

a container adapted to contain product for mixing with a carrier stream;

a container interface for interfacing said sprayer with said container, said container comprising a container neck portion having an annular flange and a flat annular surface extending in a direction transverse to the annular flange;

said container interface being displaceable with respect to said container;

said container interface being rotatable about a rotational axis extending in a longitudinal direction between a first position, wherein said container interface is removable from said container, and a second position;

an adjuster which establishes a delivery condition of a carrier stream and product;

said adjuster being actuable between:

a first setting, wherein no carrier stream is admitted through said sprayer;

a second setting, wherein solely a carrier stream is admitted through said sprayer;

a third setting, wherein product is admitted into a carrier stream admitted through said sprayer;

a first safety arrangement which acts to ensure a more hindered transition of said adjuster from said first setting towards said third setting than from said third setting towards said first setting, said second setting is intermediate to said first and third settings;

said first safety arrangement comprising:

a tab disposed on said sprayer, said tab being displaceable in a direction different than a direction corresponding to a linear direction of travel of said first and second engagement portions;

a first engagement portion, disposed on said adjuster, which is engageable with said tab as said adjuster transitions from said first setting to said second setting; and a second engagement portion, disposed on said adjuster, which is engageable with said tab as said adjuster transitions from said second setting to said first setting;

said first engagement portion and said second engagement portion being comparatively shaped to ensure a more hindered transition of said adjuster from said first setting to said second setting than from said second setting to said first setting;

wherein said first engagement portion comprises an edge configured to displace said tab as said adjuster transitions from said first setting to said second setting;

wherein said second engagement portion comprises a bevel configured to displace said tab as said adjuster transitions from said second setting to said first setting; and a second safety arrangement which acts to arrest displacement of said container interface from said second position towards said first position upon said container interface displacing from said first position to said second position;

said second safety arrangement comprising:

a tab extending below said container interface, said tab having a first surface extending in the longitudinal direction; and a ramp and an integral stop associated with said container, said stop comprising a second surface extending in the longitudinal direction, said ramp having a slope extending from the flat annular surface of the container neck;

said second surface acting to contact said first surface as said container interface displaces from said second position towards said first position and thereby arrest displacement of said container interface from said second position towards said first position;

said ramp acting to guide said tab such that said tab travels along said ramp and clears said stop as said container interface displaces from said first position towards said second position.

* * * * *